United States Patent [19]

Smith et al.

[11] 4,003,494

[45] Jan. 18, 1977

[54] SHEET METAL CONTAINER COMPONENT

[75] Inventors: George L. Smith, New Kensington; Milton L. Stineman, Shelocta, both of Pa.

[73] Assignee: Aluminum Company of America, Pittsburgh, Pa.

[22] Filed: Jan. 14, 1976

[21] Appl. No.: 648,904

[52] U.S. Cl. ..... 220/268; 113/121 C; 222/541

[51] Int. Cl.[2] ..... B65D 17/00

[58] Field of Search ..... 220/266, 268; 113/121 C; 222/541, 480; 215/253

[56] References Cited

UNITED STATES PATENTS

| | | | |
|---|---|---|---|
| 3,902,627 | 9/1975 | Gane | 220/268 |
| 3,929,251 | 12/1975 | Urmston | 220/268 |
| 3,964,414 | 6/1976 | Gane | 113/121 C |

*Primary Examiner*—George T. Hall
*Attorney, Agent, or Firm*—David W. Brownlee; William J. O'Rourke, Jr.

[57] ABSTRACT

An improved method of forming and construction for a tabless, digitally openable sheet metal container component including at least two inwardly displaceable, adjacently disposed opening panels. The opening panels are substantially rigid and are located within an integral deflectable portion projecting outwardly from the general plane of the surface wall of the container component and having a common deflectable surface between the opening panels in the form of a raised bridge of metal therebetween designed to respond to digitally applied pressure creating stress sufficient to initiate substantially simultaneous fracture of frangible webs which define the loci of separation of the opening panels. The container component is formed by opposed die sets which, in a single operation, extrude metal from between opposing die surfaces to produce a thin residual of metal in the frangible web around each opening panel and form the deflectable portions around the opening panels.

11 Claims, 6 Drawing Figures

SHEET METAL CONTAINER COMPONENT

BACKGROUND OF THE INVENTION

1. Field of Invention

This invention relates to a sheet metal container component and more particularly to an improved method and apparatus for forming and a construction of a digitally openable container component such as an end closure that provides ready access to the liquid contents through displaceable panels which are opened by applying downward digital pressure immediately adjacent the opening panels to deflect a surface common to both deflectable bubble configurations causing fracture of a frangible web around the panels to form openings in the closure wall. This component satisfies commercial requirements dictated by ecological demands and safety considerations.

2. Description of the Prior Art

The metal can has gained widespread acceptance as a beverage container. In fact, in 1974 over 60 billion metal cans were produced to hold beer, soda and other liquids. Most of these metal beverage cans have been constructed with a severable tab to allow ready access to the contents without requiring the use of a can opener or other similar auxiliary tool. There are numerous examples of tab openings in the prior art including U.S. Pat. Nos. 3,291,336 and 3,411,470.

More recently, public opinion and legislation have been directed against the tear-away tab in an ecological attempt to eliminate the removable top litter. The removable tabs have sometimes been discarded indiscriminately by the ultimate consumers in picnic grounds, on public beaches, along roadways and in lakes or streams. Fish and other wildlife have apparently been lured to these shining tabs and may have been killed as a result of consuming them.

The ideal ecological closure member for a beverage container should have an opening means which can be easily fractured, preferably with relatively little digital pressure, and yet remain integrally attached to the metal container. Since the 1930's, opening panels have been known that are entirely cut from the container wall and held in place with a sealant. The bond between the sealant and the container wall is fractured by applying downward pressure with the thumb, while the opening panel folds over the thin metal to form an opening hinge, as disclosed in U.S. Pat. No. 2,176,898. See also U.S. Pat. No. 3,886,881. To provide adequate sealant to the cut line around the opening panel is a time consuming and expensive operation.

U.S. Urmston Pat. No. 3,929,251 discloses an improved ecological closure having at least one opening panel defined by a fracturable web with an integral deflectable portion adjacent the panel. Upon applying digital downward pressure against the deflectable portion, fracture of the web is induced to permit inward displacement of a separated opening panel. A novel feature of that container component is that the application of localized digital pressure immediately adjacent the rigid opening panel initiates fracture of the web around the panel. Other prior art disclosures of interest are contained in U.S. Pat. No. 3,730,381 and U.S. Pat. No. 3,902,627. Fracture of the score in those prior art devices is accomplished by applying pressure to the defined opening panel itself, usually with an auxiliary tool such as a coin or with the fingers. The prior art also discloses a raised zone on the can end requiring several deflections thereagainst to cause the residual metal to fail, as shown in U.S. Pat. No. 3,638,825. A convex tab which can be flexed into a concave position is disclosed in U.S. Pat. No. 3,779,417.

The provision of adjacent multiple opening panels is well known. For example, adjacent multiple openings are known for containers having circular rotor members on the closure. The openings have been formed either on the rotor member, as in U.S. Pat. No. 3,100,589, or on the container itself, as in U.S. Pat. No. 3,115,994. These multiple openings are formed to control the amount and type of dispensing action desired, as is used in the sifting action of an ordinary salt shaker. Prior art also discloses a metal container wall comprising an inner tinplate ply having a plurality of openings under a pealable strip, as in U.S. Pat. No. 3,318,495. This series of openings is formed for pouring as well as venting. Utilization of a series of openings rather than one large opening also aids in maintaining the adhesion of the pealable strip in cans having high internal pressures, by dispersing the pressure against the strip to a few small areas rather than one large area. Methods for scoring a container closure are disclosed in U.S. Pat. No. 3,688,718. Other prior art disclosures of interest relative to methods and tools for forming opening panels in sheet metal containers include the following U.S. Pat. Nos.: Geiger 3,362,569 and Punte 2,187,433.

SUMMARY OF THE INVENTION

This invention may be summarized as providing an improved method and apparatus for forming and construction of a tabless, digitally openable container component having multiple substantially rigid opening panels therein. In its broad aspects the container component includes a planar wall having at least two inwardly displaceable, adjacently disposed opening panels. Each opening panel is defined by a frangible web, and is located in an integral deflectable portion. The deflectable portions, which resemble a bubble configuration overlap to provide a common raised bridge of metal separating the opening panels. The deflectable portions are designed to effect initial fracture at the web in response to relatively modest digital pressure applied thereagainst in a downward direction.

In its narrower aspects, this invention includes the formation of at least two opening panels upon deflectable portions which overlap to provide a common deflectable surface or locus between the opening panels. This formation involves the displacement of metal in the container wall to form the frangible webs by moving metal adjacent a predetermined line substantially perpendicular to the surface wall while compressing a zone of metal along such line between substantially parallel die surfaces which are disposed at an angle to the plane of the container wall. Such compressing of the surface wall extrudes metal laterally from such line to produce a bulge forming a part of the deflectable portion which is flexed similar to the flexing of an oil can to cause relative movement of the sheet metal on opposite sides of the frangible web and thereby facilitate initiation of fracture of the web.

Among the advantages of the subject invention is the provision of a sheet metal container component which eliminates removable top litter and which can be fabricated with a minimal number of fabricating steps at extremely high production rates with simple tooling. Further advantages include the provision of an end closure that can be opened with the application of a modest amount of digitally applied pressure without the use of auxiliary tools to permit inward displacement of opening panels sized larger than the resulting opening in the container wall.

It follows that an object of this invention is the provision of an improved method and apparatus for forming and construction of a digitally openable sheet metal container component.

Another object of this invention is to provide a container wall which can be opened with the finger or thumb without removable top litter such as a tab or tool.

A further object of this invention is to provide a method of forming frangible webs, which define the opening panels located on overlapping deflectable portions having a common surface. The frangible webs are designed to fracture substantially simultaneously when force is applied against the deflectable portion on the common surface between the opening panels.

Another object of this invention is to provide a large pouring area comprised of multiple panels, rather than a single panel, equally sized greater than any of the resulting openings in the surface wall of the container such that a separated opening panel could not escape the container during pouring or drinking.

Another object of this invention is to provide a large pouring area comprised of multiple small opening panels, rather than a single, large opening panel, sized such that the average finger cannot become wedged inside the resulting opening in the container wall after fracture of the web which might otherwise cause laceration of the finger.

Another object of this invention is to provide a large pouring area comprised of multiple panels, rather than a single panel, which will subsequently pour in a manner similar to a single panel in that the streams of liquid when poured through multiple adjacently disposed openings will converge at a point beyond the openings and will flow therefrom as a single stream of liquid.

Another object of this invention is to provide a method of forming a sheet metal container component to provide selectively contoured frangible webs, which define the opening panels located within a formed deflectable portion, to permit fracture of such webs when force is applied against the deflectable portion on the common surface between the opening panels.

The foregoing and other objects and advantages of this invention will be more thoroughly comprehended and appreciated with reference to the following description and the drawings appended hereto.

DESCRIPTION OF THE PREFERRED EMBODIMENTS

Figure 1:
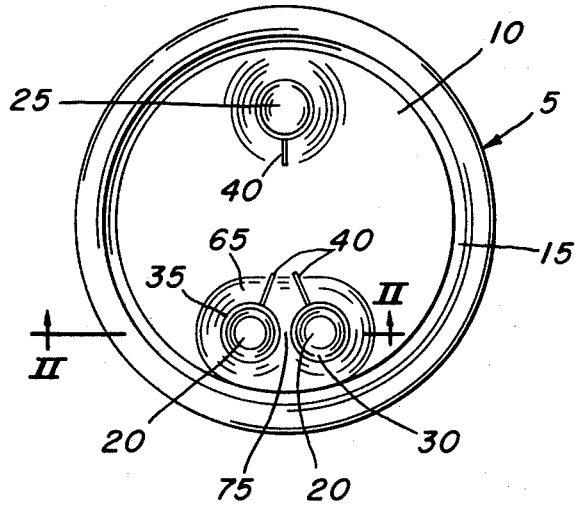
FIG. 1 is a plan view of a can end of the invention.
Figure 2:
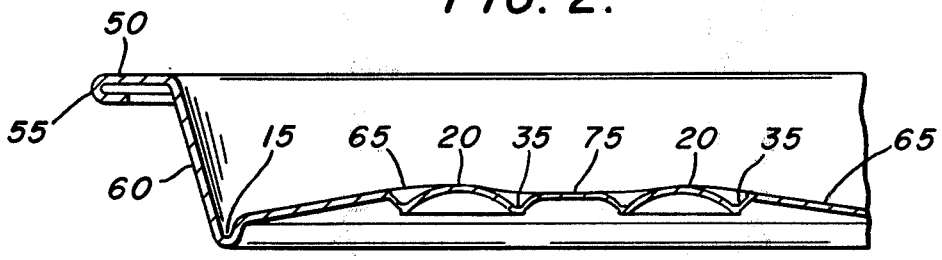
FIG. 2 is an enlarged cross sectional view through a portion of the can end of FIG. 1 taken along lines II—II.

Referring particularly to the drawings, FIGS. 1 and 2 illustrate a sheet metal container closure or can end 5 which includes a substantially planar surface wall 10, a peripheral groove 15 bounded on the inside circumference by the surface wall 10 and bounded on the outside circumference by the upstanding wall 60, and a flange 50 extending outwardly from the top of the upstanding wall 60 with a curled edge 55 on such flange. This construction is typical of can ends designed to be sealed on container bodies by conventional double seaming operations.

A preferred embodiment of can end 5 of this invention includes at least two inwardly displaceable, adjacently disposed opening panels 20 equally sized and defined by a frangible web 35 formed in the surface wall 10 around each panel. Each opening panel 20 is located on a deflectable portion 65, with the deflectable portions 65 overlapping to form a common bridge surface 75 separating the adjacent opening panels 20. The frangible webs 35 around each opening panel may be continuous or uninterrupted so the opening panel defined thereby can be completely separated from the can end 5 when fractured. However, as shown in the illustration of the preferred embodiments in FIGS. 1 through 4, each frangible web 35 is preferably open or interrupted by a hinge 30 which is approximately 1/16 of an inch or smaller to normally prevent complete separation of the opening panels 20 from the can end 5 in case of an accidental rupture caused by high internal pressure or after inward displacement.

Each panel 20 preferably has a diameter larger than the opening which results when the panel 20 is displaced into the container. This feature is obtained when the metal across the weakening line defined by the frangible web 35 is in overlapping relationship. In other words, at least a portion of the undersurface of the deflectable portion 65 and so the outer edge of the opening panel 20 at least partially underlies the inner edge of the lip of the deflectable portion 65. Therefore, since a preferred embodiment of this invention provides a can end 5 having multiple opening panels 20 of the same size, an opening panel 20, which is completely displaced and separated, cannot inadvertently be poured or dispensed through any of the resulting openings in the can end 5.

It is a further optional feature of a sheet metal container component of this invention that the surface wall 10 has shallow score lines 40 therein of approximately ¼ inch in length running from the generally planar surface wall 10 into the deflectable portion 65 terminating just short of the frangible web 35. The score lines 40, which extend radially from the opening panels 20, provide stress risers to concentrate the stresses produced by digital pressure applied to the deflectable portion 65 to a specific point on the frangible web 35 to aid in causing the initial fracture of the web.

It is another feature of this invention that the surface wall 10 includes an additional opening panel 25 which upon opening serves as an air vent. All the opening panels 20 and 25 are preferably the same size, and have diameters larger than the openings which result when the panels are displaced into the container. Thus, if any panel happens to completely separate from the container wall and falls into the container, the panel will be confined inside the can. This safety feature would not be provided by a can end having a relatively small air vent and a larger single opening panel.

The circular opening panels 20 which together provide a large pouring area are preferably small enough that the average size finger will not be caught in the opening which results after the opening panels 20 are displaced inside the can end 5. Although digital pressure against the deflectable portion 65 will initiate fracture of the frangible web 35, the opening panel 20 must usually then be pressed directly to displace it inwardly of the can end 5. Such direct pressure application against the panel exposes the finger of the consumer to the fractured edge of the frangible web 35. To minimize the risk imposed by such exposure, the opening panels 20 in the preferred embodiment of this invention are approximately ⅜ inch in diameter to prevent insertion of a finger into the opening.

The deflectable portion 65, illustrated in FIGS. 1 and 2, is formed outwardly with respect to the undisplaced surface wall 10 of the can end 5, with the opening panels 20 located thereon. Between the adjacent opening panels 20 on the deflectable portion is a raised bridge of metal 75 which is common to both panels.

In the preferred embodiment, a singular deflectable portion 65 is elliptical in configuration with the adjacent circular opening panels 20 centered approximately on the major axis of the ellipse; and an imaginary bend line running substantially along the minor axis of the ellipse will localize the subsequent flexing of sheet metal between the opening panels 20. However, it should be understood that a single deflectable portion 65 may also be formed which substantially resembles an embossed figure "8". Digital pressure applied against the deflectable portion 65 between the opening panels 20 will cause flexing and selective displacement of the sheet metal along the bend line to facilitate initial fracture of both frangible webs 35 substantially simultaneously. It is believed that this flexing directed toward the common deflectable surface 75 between the opening panels causes relative movement of adjacent portions of metal on opposite sides of both frangible webs 35 to thereby bend and stress the thin residual of metal constituting the web 35 causing initial fracture thereof.

Substantial symmetry of the deflectable portion 65 is desired to effect a dual response to inwardly directed digitally applied pressure to strain the frangible webs 35 of each opening panel 20 substantially simultaneously thus initiating fracture of the webs 35 of both panels 20. This inwardly directed digital pressure is preferably applied on the deflectable portions 65 between the opening panels 20 at the base of the common bridge surface 75 on the side of the bridge 75 facing the center of the can end 5. The opening panels 20 are relatively rigid to resist bending thereof and thereby insure that the displacement of the deflectable portion 65 will create the stress sufficient to initiate fracture of the frangible web 35.

Direct digital pressure against the opening panel 20 itself will complete the fracture, if necessary, and will displace the panel 20 inside the container so not to restrict or obstruct the flow of liquid during pouring or drinking. As illustrated in FIG. 1, the opening panel 20 may be formed with a hinge 30 around which the panel must be inwardly displaced. As further illustrated in FIG. 1, a single opening panel 25 is preferably provided opposite the pair of opening panels 20, discussed above, and upon opening serves to vent air and thus atmospheric pressure into the container to facilitate pouring.

Figure 3:
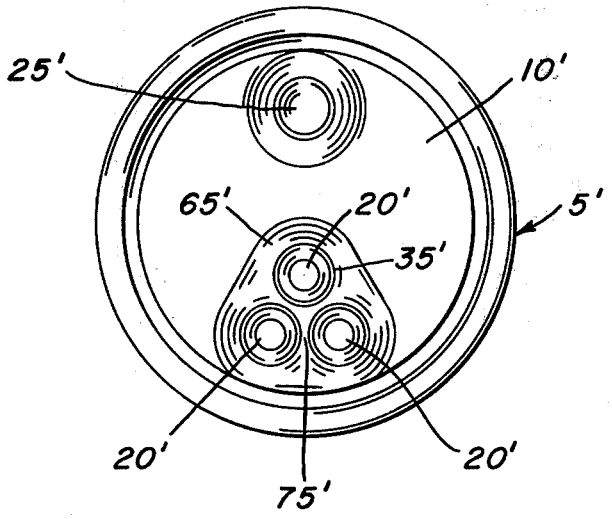
FIG. 3 is a plan view of a can end of an alternative embodiment of a closure of the invention.

FIG. 3 illustrates another embodiment of an easy-open container incorporating the principle of this invention which is particularly adapted to increasing the pouring area of the container without substantially increasing the size of the opening panels. Can end 5' includes a surface wall 10' upon which there are formed three adjacently disposed opening panels 20' centrally located in a common triangular deflectable portion 65'. The deflectable portion forms a common bridge surface 75' which when depressed inwardly with digitally applied pressure will cause initial fracture of the frangible webs 35' of all three panels 20' substantially simultaneously. FIG. 3 also shows a single air vent 25' of the same configuration as each of the opening panels 20'.

Figure 4:
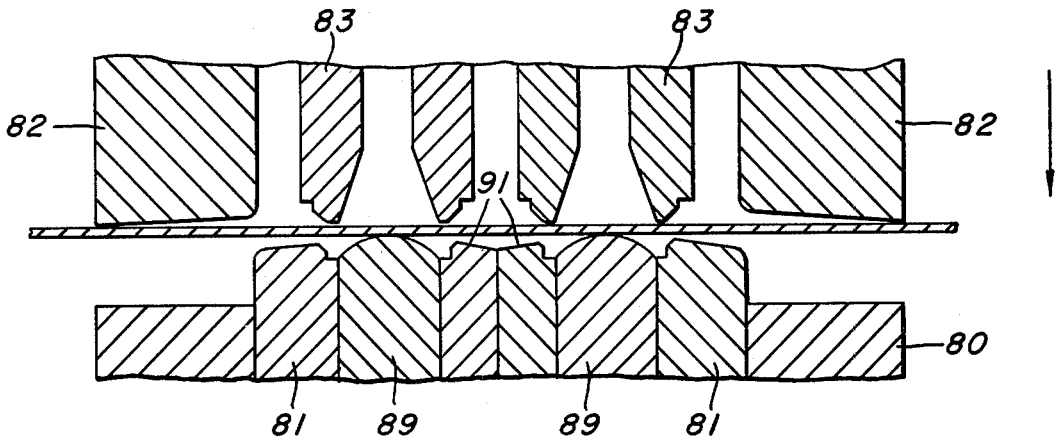
FIG. 4 is a cross section illustrating tools for deforming a container wall in accordance with the invention.
Figure 5:
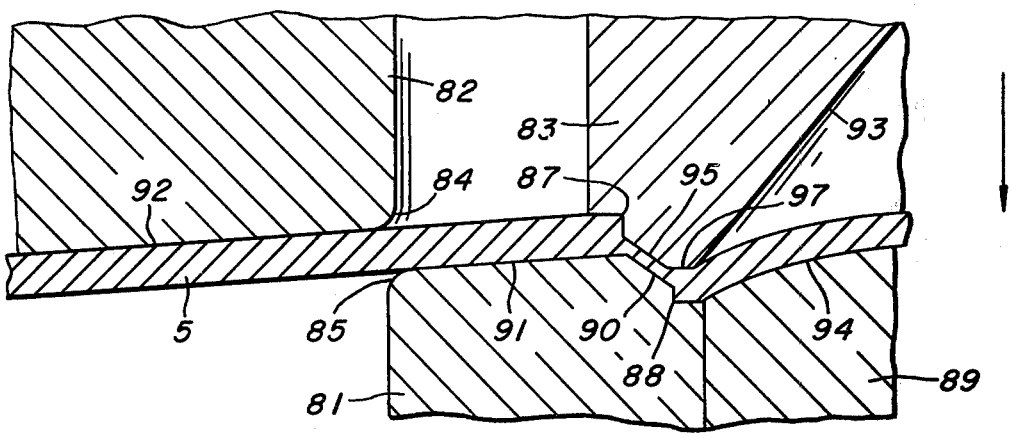
FIG. 5 is an enlarged cross sectional view illustrating the tools deforming a container wall in accordance with the invention.
Figure 6:
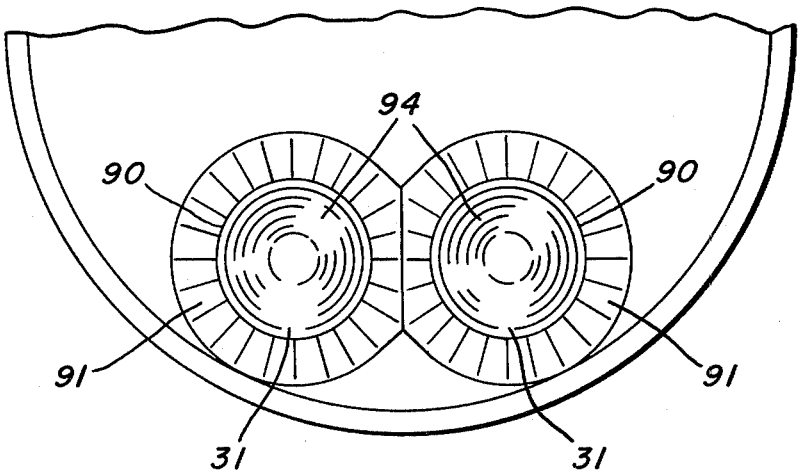
FIG. 6 is a top plan view of the bottom die set and the auxiliary die means.

FIGS. 4, 5, and 6 illustrate exemplary tools and a preferred method for forming the particularly contoured frangible web and deflectable portion in accordance with the invention. Such tools include a first die set comprised of tool inserts 83 and an annular auxiliary die means 82 around the die inserts. Each tool insert 83 has a substantially horizontal downwardly facing metal shaping base surface 97, a frustoconic extruding surface 95 extending at approximately a 45° angle from the metal shaping base surface 97 terminating in an annular step 87 in the die and an upwardly inclined frustoconic inner surface 93. The auxiliary die means 82 has a frustoconic surface 92 which is disposed at approximately a 15° angle to the horizontal and which terminates at a rounded corner 84.

The second die set is comprised of dies 81 secured by tool holder 80 and die members 89 which have domed working surfaces. Each die 81 further has a frustoconic extruding surface 90 substantially parallel to and mating with the extruding surface 95 of the first die set, thus at approximately a 45° angle to the direction of die travel indicated by the arrows in FIGS. 4 and 5 which terminates near annular step 88. Each die 81 is provided with an upwardly facing base surface 91, inclined at a slight angle of approximately 15° to the horizontal, which terminates at a rounded corner 85 generally opposite rounded corner 84 on the auxiliary die means 82. Inclined die surfaces 91 circumscribe extruding surfaces 90 at a width of approximately 1/16 to ⅛ inch. As is best seen in FIG. 6, the width of the die surface 91 around each die 81 is constant except between the dies 81 where the side of each die has been machined flat along substantially equal chords which are in abutting position between the die inserts.

In the operation of the dies of FIGS. 4 and 5, the first die set is moved toward the second die set against a sheet metal can end 5 which has been introduced therebetween. This downward direction of die travel is indicated by the arrows in FIGS. 4 and 5. Metal from the surface wall 10 of the can end 5 is first stretched over the dome surfaces 94 of dies 81. As the dies further close the base surfaces 97 and the extruding surfaces 95 are lineally displaced toward corresponding base surface 91 and extruding surface 90. As compression of the dies continues metal is extruded from between the angularly offset parallel metal extruding surfaces 90 and 95. During such extrusion the metal in the surface wall is squeezed between the extruding surfaces 90 and 95 of the dies causing lateral flow or extrusion of metal away from the thin forming frangible web. Extruding surface 90 may be slightly interrupted to provide a hinge forming surface 31 to prevent extrusion at the interruption, thereby facilitating the formation of a hinge 30 on the container closure to impede total displacement of formed opening panels 20.

In the formation of the domed opening panels 20, the inner surfaces 93 of the tool inserts are preferably inclined so as not to interfere with the formation of the opening panels when the surface wall 10 is finally pressed to conform to the shape of the domed surfaces 94 of die members 89.

Movement of tool holder 82 having first rounded corner 84 toward dies 81 having seconded rounded corner 85 forms the deflectable portion 65 in the surface wall 10 of the sheet metal can end 5, by the conjoint action of the surface 92 of die holder 82 and the similarly inclined surface 91 of die 81.

Rounded corner surfaces 84 and 85 may be adapted to further cooperate in the formation of the deflectable portion in the surface wall 10. The tools 81 and 82 may be closed further than illustrated in FIG. 5 so the corner surfaces 84 and 85 will coin and/or thin the sheet metal container component therebetween when the die means are closed. Such coining may facilitate forming a deflectable portion 65 in container component, especially those having opening panels 20 with greater than ⅜ inch diameter, and may also facilitate inward displacement of such a deflectable portion 65.

If desired score lines 40, shown in FIG. 1, may be formed in the surface wall 10 either in a separate operation prior to the formation of the opening panels 20 or substantially simultaneously with the formation of the opening panels 20. Scoring may be effected by truncated indentor tools, not shown, positioned in the top die set. Anvils may be provided in an underlying position with respect to the sheet metal can end 5 to support the indentor tools. In effecting scoring the surface wall 10 is received on the anvil and the indentor tool is rapidly brought downwardly to provide forceful impact with the metal surface wall 10. Depending upon the specific configuration of the indentor tool, the score line may result from either physical displacement of the metal or extruded metal flow or both.

The method of this invention is particularly adapted for container end walls made of work hardened aluminum base alloy sheet material in the thickness range of 0.01 to 0.02 inch which is at least quarter hard. It is believed that such work hardened alloy sheet material is well suited to the method of this invention because at least quarter hard material is required to assure fracture of the web when stress occurs upon deflection. Also, after extrusion the work hardened sheet material is merely about 0.002 inch wide at the thinnest portion of the web. The yield strength must be such that the web will not prematurely rupture from internal pressure during shipping and handling of the beverages.

While the preferred tools and method of forming a container component according to this invention have been described above, it would be readily apparent to those skilled in the art that this invention also comprehends coining tools which form V-shaped indentations in the surface of the metal providing a frangible web of metal at the root of this indentation. Such coining tools are illustrated and described in U.S. Pat. No. 3,902,626.

Whereas the particular embodiments of this invention have been described above for purposes of illustration, it will be apparent to those skilled in the art that numerous variations of the details may be made without departing from the invention.

What is claimed is:

1. A sheet metal container component having a generally planar wall comprising:

at least two inwardly displaceable, adjacently disposed, substantially rigid opening panels, each of said opening panels having a frangible web therearound defining a locus of separation of said opening panel from said wall, and integral deflectable portions projecting outwardly from the general plane of said wall with said opening panels located therein and said deflectable portions having a common surface between said opening panels to provide a raised bridge of metal separating the opening panels to facilitate initiation of fracture of the web around each opening panel.

2. A sheet metal end closure of work hardened aluminum alloy comprising:

a wall portion peripherally chimed for securement to a container body, at least two inwardly displaceable, adjacently disposed, substantially rigid opening panels located toward the peripheral chime on the end closure, each of said opening panels having a frangible web therearound defining a locus of separation of said opening panel from said wall portion, and integral deflectable portions projecting outwardly from the general plane of said wall portion with said opening panels located therein with said deflectable portions having a common surface between said opening panels to provide a raised bridge of metal separating the opening panels to facilitate initiation of fracture of the web around each opening panel.

3. A sheet metal end closure as set forth in claim 2 wherein said deflectable portion is adapted to respond to inwardly directed pressure, digitally applied thereagainst to effect a relative displacement of the metal on opposite sides of said frangible web increasing the stress in said webs to initiate fracture thereof and permit internal displacement of each separated opening panel.

4. A sheet metal end closure as set forth in claim 2 in which said opening panels are circular.

5. A sheet metal end closure as set forth in claim 2 wherein said frangible web around each opening panel is interrupted to form a hinge element which impedes total fracture of the opening panels.

6. A sheet metal end closure as set forth in claim 2 having an inwardly displaceable air vent located toward the peripheral chime opposite said opening panels.

7. A sheet metal end closure as set forth in claim 6 in which said opening panels and said air vent are of the same diameter, said opening panel diameter being greater than the diameter of the frangible web, such that all the opening panels are confined internally after total displacement of the opening panel into the container.

8. A sheet metal end closure as set forth in claim 2 having score lines of approximately ¼ inch in length extending radially of each opening panel and located on the deflectable portion terminating at or immediately before the frangible webs of the opening panels.

9. A sheet metal container component having a generally planar wall comprising:

two inwardly displaceable, adjacently disposed, substantially rigid opening panels, each of said opening panels having a frangible web therearound defining a locus of separation of said opening panel from said wall, and an integral deflectable portion projecting outwardly from the general plane of said wall with said opening panels located therein and said deflectable portion generally elliptical in configuration to provide a bend line substantially along the minor axis of the ellipse in a common deflectable surface between said opening panels to provide a raised bridge of metal separating the opening panels to facilitate initiation of fracture of the web around each opening panel.

10. A sheet metal container component having a generally planar wall comprising:

three inwardly displaceable, adjacently disposed, substantially rigid opening panels, each of said opening panels having a frangible web therearound defining a locus of separation of said opening panel from said wall, and integral deflectable portions projecting outwardly from the general plane of said wall with said opening panels located therein and said deflectable portions having a common surface between said opening panels to provide a raised bridge of metal separating the opening panels to facilitate initiation of fracture of the web around each opening panel.

11. A sheet metal end closure of at least quarter hard temper aluminum alloy of an initial thickness in the range of 0.01 to 0.02 inch suitable for sealing on a container body by seaming operations comprising:

at least two inwardly displaceable, adjacently disposed, substantially rigid opening panels, each of said opening panels having a frangible web therearound defining a locus of separation of said opening panel from said wall, said frangible web being no greater than .0015 inch wide at its narrowest point after formation, and an integral deflectable portion projecting outwardly from the generally planar wall with said opening panels located thereon, said deflectable portions having a common surface between said opening panels to provide a raised bridge of metal separating the opening panels to facilitate initiation of fracture of the web around each opening panel.

* * * * *